US010221590B2

(12) United States Patent
Sanford

(10) Patent No.: US 10,221,590 B2
(45) Date of Patent: Mar. 5, 2019

(54) LOCKABLE ENCLOSURE WITH COMBINATION LOCKING MECHANISM

(71) Applicant: Master Lock Company LLC, Oak Creek, WI (US)

(72) Inventor: Eric Sanford, Milwaukee, WI (US)

(73) Assignee: Master Lock Company LLC, Oak Creek, WI (US)

( * ) Notice: Subject to any disclaimer, the term of this patent is extended or adjusted under 35 U.S.C. 154(b) by 94 days.

(21) Appl. No.: 15/428,484

(22) Filed: Feb. 9, 2017

(65) Prior Publication Data

US 2017/0234038 A1 Aug. 17, 2017

Related U.S. Application Data

(60) Provisional application No. 62/294,480, filed on Feb. 12, 2016.

(51) Int. Cl.

| | |
|---|---|
| ***E05B 65/00*** | (2006.01) |
| ***E05B 17/10*** | (2006.01) |
| ***E05B 19/00*** | (2006.01) |
| ***E05B 37/00*** | (2006.01) |
| ***E05B 37/02*** | (2006.01) |
| ***E05C 1/08*** | (2006.01) |
| ***E05G 1/00*** | (2006.01) |

(Continued)

(52) U.S. Cl.

CPC ..... *E05B 65/0075* (2013.01); *E05B 17/10* (2013.01); *E05B 19/0005* (2013.01); *E05B 37/0058* (2013.01); *E05B 37/0068* (2013.01); *E05B 37/02* (2013.01); *E05B 37/025* (2013.01); *E05C 1/08* (2013.01); *E05G 1/005* (2013.01);

(Continued)

(58) Field of Classification Search

CPC ..... E05B 65/48; E05B 65/0075; E05B 17/10; E05B 19/0005; E05B 37/00; E05B 37/0058; E05B 37/0068; E05B 37/02; E05B 37/025; E05B 67/00; E05B 67/02; E05B 67/22;

(Continued)

(56) References Cited

U.S. PATENT DOCUMENTS 1,950,503 A * 3/1934 Mahon ..... E05B 37/0096 70/178
3,452,563 A * 7/1969 Atkinson ..... E05B 37/12 70/312

(Continued)

FOREIGN PATENT DOCUMENTS

CA 2783204 A1 12/2008
WO 2011/053949 A1 5/2011

OTHER PUBLICATIONS

International Search Report and Written Opinion for PCT/US2017/017148 dated May 4, 2017.

*Primary Examiner* — Suzanne L Barrett
(74) *Attorney, Agent, or Firm* — Calfee, Halter & Griswold LLP

(57) ABSTRACT

A lockable enclosure includes a housing and an access door assembled with the housing and movable between a closed position and an open position. A latch is carried by the access door and is slideable along a first axis between a door latching and a door releasing position. A plurality of dials are carried by the access door and rotatable about a post extending along a second axis. When each of the plurality of dials is rotated to an unlocking orientation, an outer peripheral recess on each of the dials aligns with a corresponding dial engaging portion of the latch, allowing the latch to slide along the first axis from the door latching position to the door releasing position.

20 Claims, 10 Drawing Sheets

(51) Int. Cl.
*E05G 1/026* (2006.01)
*E05G 1/04* (2006.01)
*E05B 67/06* (2006.01)

(52) U.S. Cl.
CPC ..... *E05G 1/026* (2013.01); *E05G 1/04* (2013.01); *E05B 67/063* (2013.01)

(58) Field of Classification Search
CPC ..... E05B 67/063; E05C 1/08; E05G 1/005; E05G 1/026; E05G 1/04
USPC ..... 70/51–53, 21–25, 63, 312
See application file for complete search history.

(56) References Cited

U.S. PATENT DOCUMENTS 4,389,863 A * 6/1983 Bako ..... E05B 37/02 70/312
4,982,586 A 1/1991 Wingert
6,845,519 B2 1/2005 Garneau
7,251,967 B2 * 8/2007 Yang ..... E05B 19/0005 70/25
7,516,631 B2 * 4/2009 Hacker ..... E05B 19/0005 109/51
8,695,385 B2 * 4/2014 Meekma ..... E05B 19/0005 292/254
2004/0226325 A1 * 11/2004 Ling ..... E05B 19/0005 70/63
2006/0213237 A1 * 9/2006 Yang ..... E05B 19/0005 70/63
2007/0091583 A1 4/2007 Dial
2011/0056251 A1 * 3/2011 Komiya ..... E05B 19/0005 70/52
2011/0079056 A1 4/2011 Sakai
2011/0100074 A1 * 5/2011 Meekma ..... E05B 19/0005 70/63
2011/0132049 A1 * 6/2011 Meekma ..... E05B 37/0068 70/314

* cited by examiner

LOCKABLE ENCLOSURE WITH COMBINATION LOCKING MECHANISM

CROSS-REFERENCE TO RELATED APPLICATION

This application claims priority to and all benefit of U.S. Provisional Patent Application Ser. No. 62/294,480, filed on Feb. 12, 2016, for LOCKABLE ENCLOSURE WITH COMBINATION LOCKING MECHANISM, the entire disclosure of which is fully incorporated herein by reference.

BACKGROUND

Combination locks are used in commercial, residential, and institutional environments to provide lockable access to personal items and/or enclosures. The combination lock may be a separate device, such as a combination padlock, which may be shackled to a door, bracket, cable, or other item to restrict access. Alternatively, the combination lock may be integral to an enclosure, such as a safe or a storage locker. Combination locks include single-dial and multiple-dial designs.

SUMMARY

A lockable enclosure includes a housing and an access door assembled with the housing and movable between a closed position and an open position. A latch is carried by the access door and is slideable along a first axis between a door latching and a door releasing position. A plurality of dials are carried by the access door and rotatable about a post extending along a second axis. When each of the plurality of dials is rotated to an unlocking orientation, an outer peripheral recess on each of the dials aligns with a corresponding dial engaging portion of the latch, allowing the latch to slide along the first axis from the door latching position to the door releasing position.

BRIEF DESCRIPTION OF THE DRAWINGS

Further features and advantages of the invention will become apparent from the following detailed description made with reference to the accompanying drawings, wherein.

DETAILED DESCRIPTION

While the embodiments described in the present application refer to a multiple-dial combination key safe, the present application relates to combination lock arrangements that may be used with many different types of locks, such as, for example, combination padlocks, safe locks, and integral locks for lockers, mailboxes, storage sheds, or other such structures and enclosures. This Detailed Description merely describes exemplary embodiments and is not intended to limit the scope of the claims in any way. Indeed, the invention as claimed is broader than and unlimited by the described embodiments, and the terms used in the claims have their full ordinary meaning.

According to one aspect of the present application, a lockable enclosure, such as, for example, a key safe, may be provided with an access door that carries a multiple-dial combination locking mechanism and a door latch that is movable to release the access door when all of the combination dials are rotated to an unlocking orientation. According to another aspect of the present application, a lockable enclosure with a multiple-dial combination locking mechanism may include a code changing mechanism allowing an authorized user (e.g., a user that knows the existing combination code) to change the combination code.

Figure 1A:
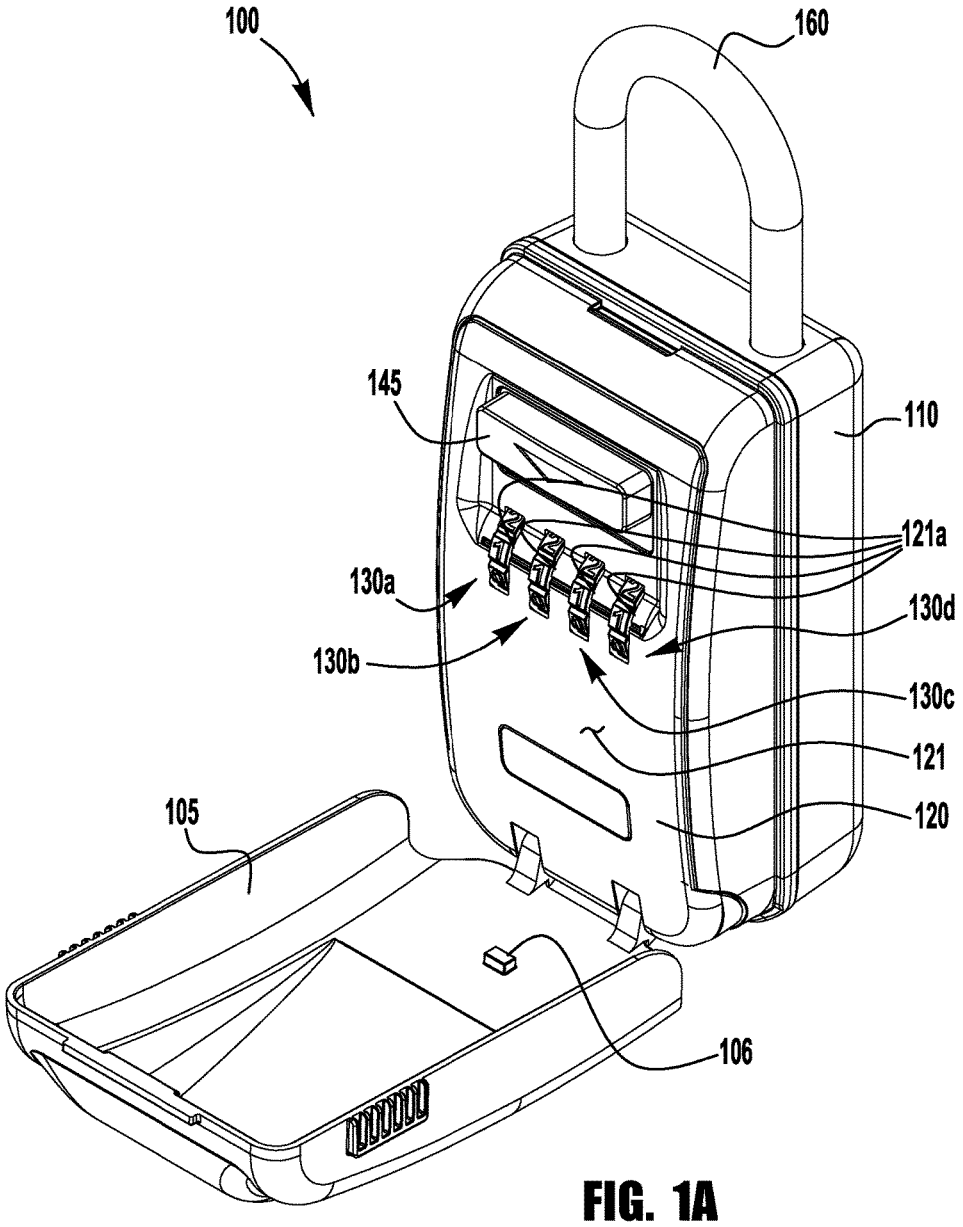
FIG. 1A illustrates a perspective view of a lockable enclosure, in accordance with an exemplary embodiment of the present application, shown with the access door in the closed position and the cover member in the open position.
Figure 1B:
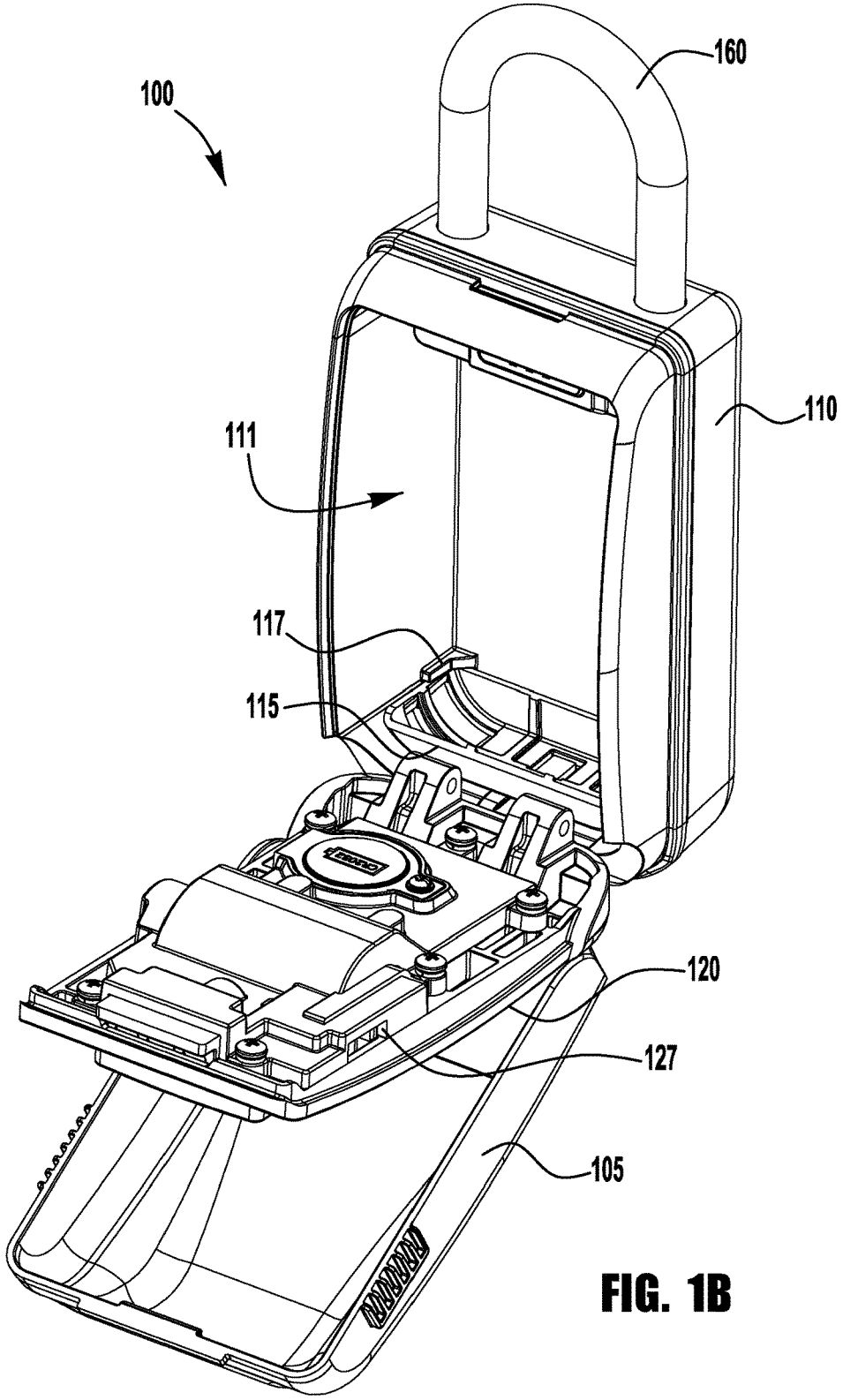
FIG. 1B illustrates a perspective view of the lockable enclosure of FIG. 1A, shown with the access door in the open position.
Figure 2:
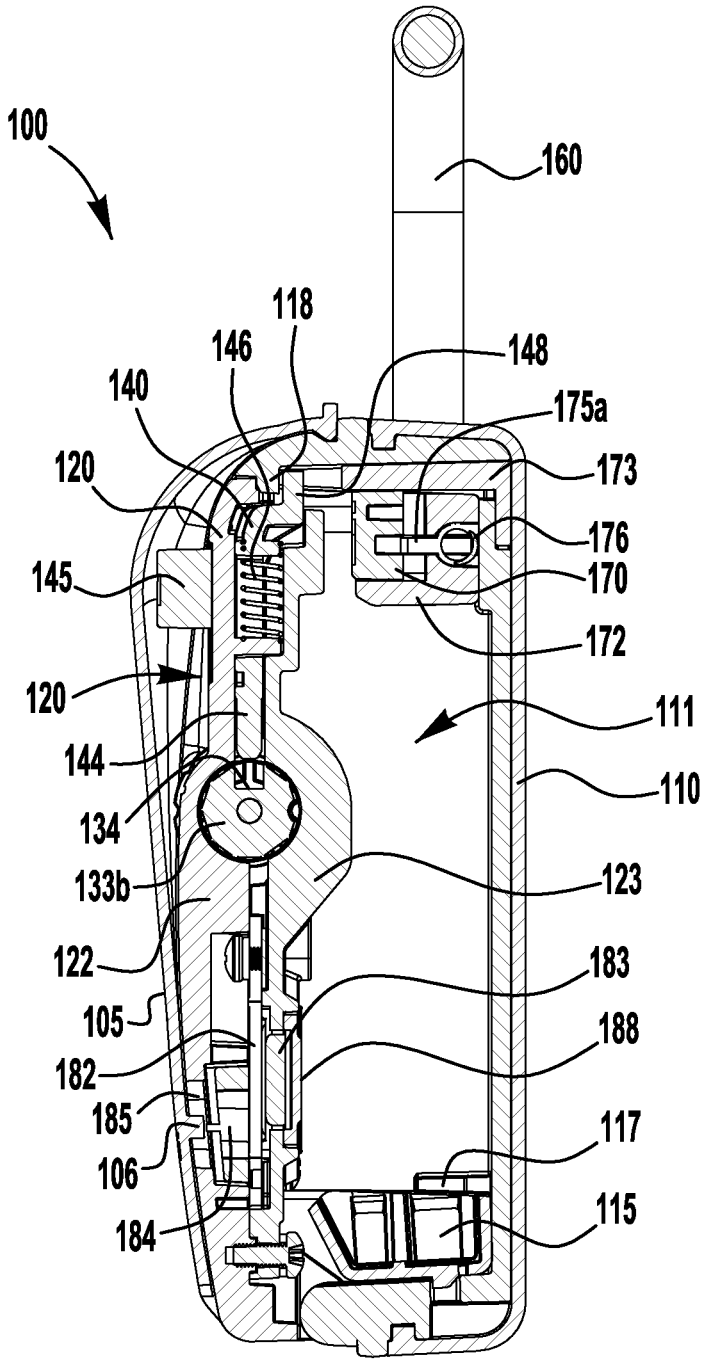
FIG. 2 illustrates a side cross-sectional view of the lockable enclosure of FIG. 1A.
Figure 3:
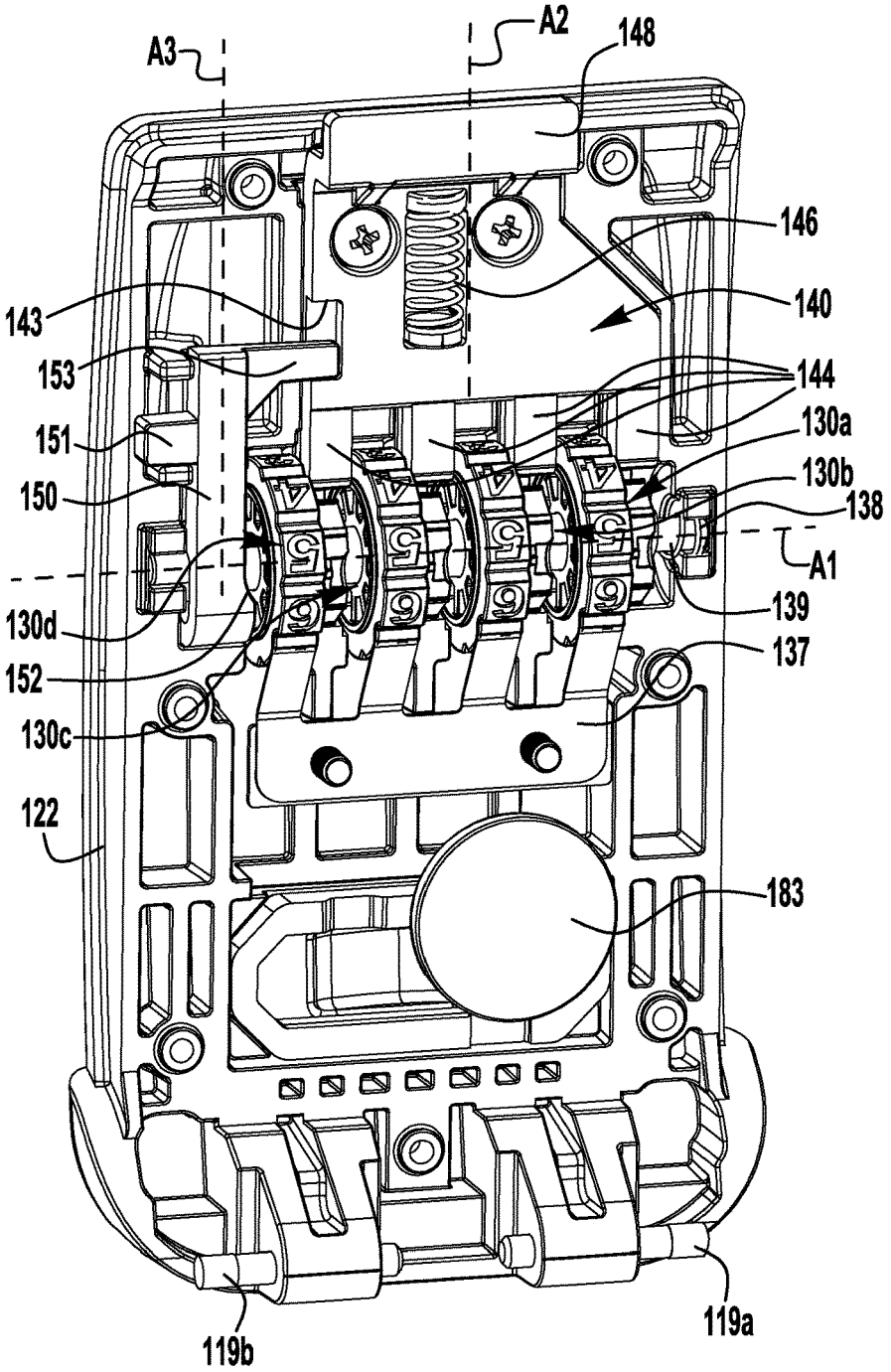
FIG. 3 illustrates a rear perspective view of the access door of the lockable enclosure of FIG. 1A, shown with the rear shell member of the access door removed to illustrate additional features of the access door.
Figure 4:
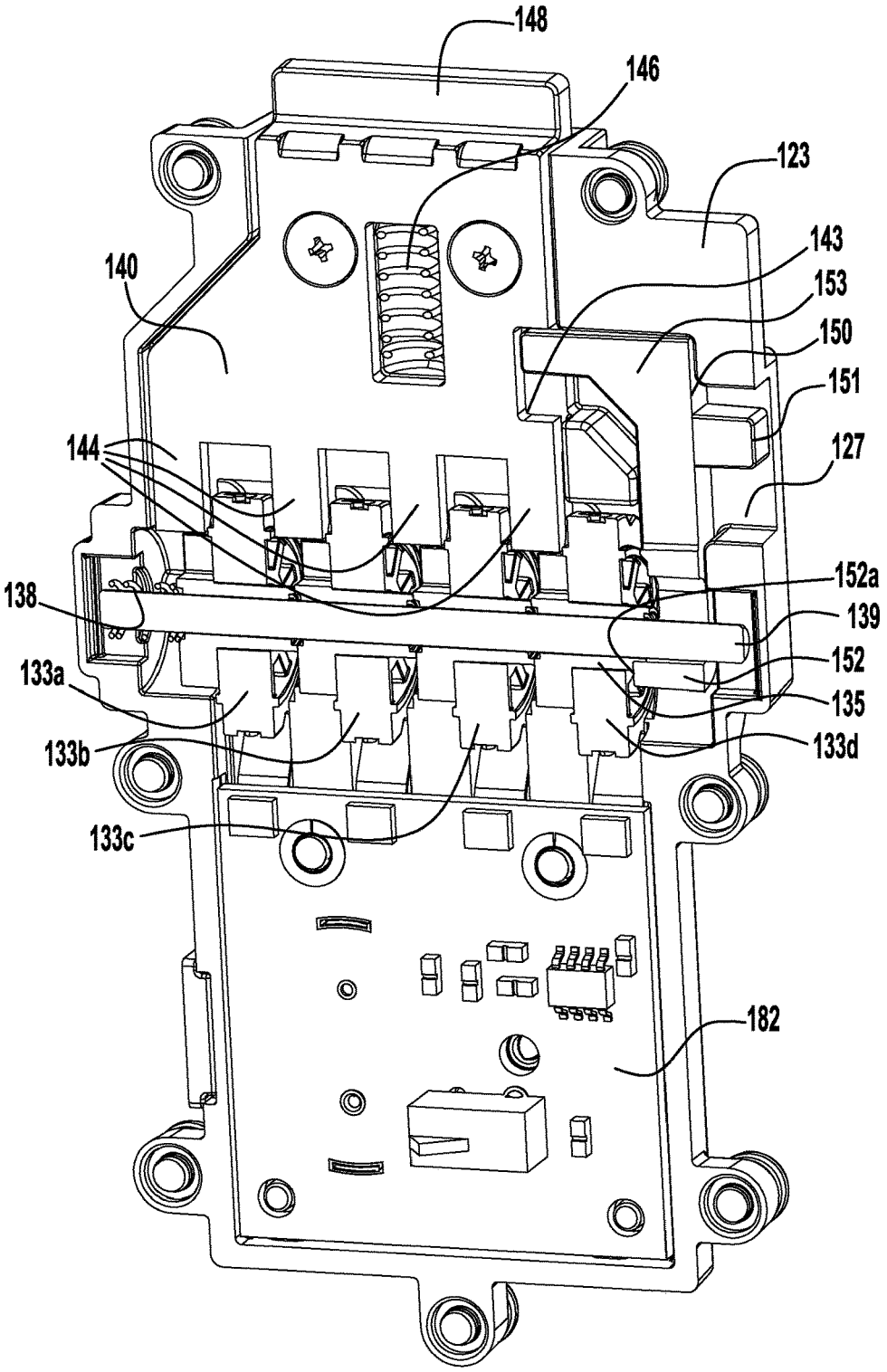
FIG. 4 illustrates a front perspective cross-sectional view of the access door of the lockable enclosure of FIG. 1A, shown with the code change member in the code changing position.

Referring now to the drawings, FIGS. 1A-8 illustrate an exemplary embodiment of a multiple-dial combination safe 100 having a code changing mechanism. As shown in FIGS. 1A and 1B, the exemplary safe 100 includes a housing 110 defining an internal compartment or cavity 111 for storing keys or other items, and an access door 120 assembled with the housing 110 and movable between a closed position (FIG. 1A) blocking access to the cavity and an open position (FIG. 1B) permitting access to the cavity. In the illustrated embodiment, the access door 120 is pivotably connected with the housing 110 by hinge pins 119*a*, 119*b* (FIG. 3). In other embodiments (not shown), the access door may be slideable, removable or otherwise movable between closed and open positions.

A series of combination dials 130*a*, 130*b*, 130*c*, 130*d* are carried by the access door 120, with user graspable portions of the combination dials protruding from or exposed through openings 121*a* in a front surface 121 of the access door 120 for user rotation of the dials 130*a*, 130*b*, 130*c*, 130*d*. While the illustrated dials include number markings to identify the rotational orientation of each dial, any types of markings may be used (including, for example, letters, pictures, and colors). A cover member 105 is pivotably connected to the access door 120 by hinge pins (not shown) for pivoting movement between a first or closed position covering the combination dials 130*a*, 130*b*, 130*c*, 130*d* (e.g., to protect the access door and combination dials from water or other contaminants), and a second or open position exposing the combination dials for user manipulation.

Figure 5:
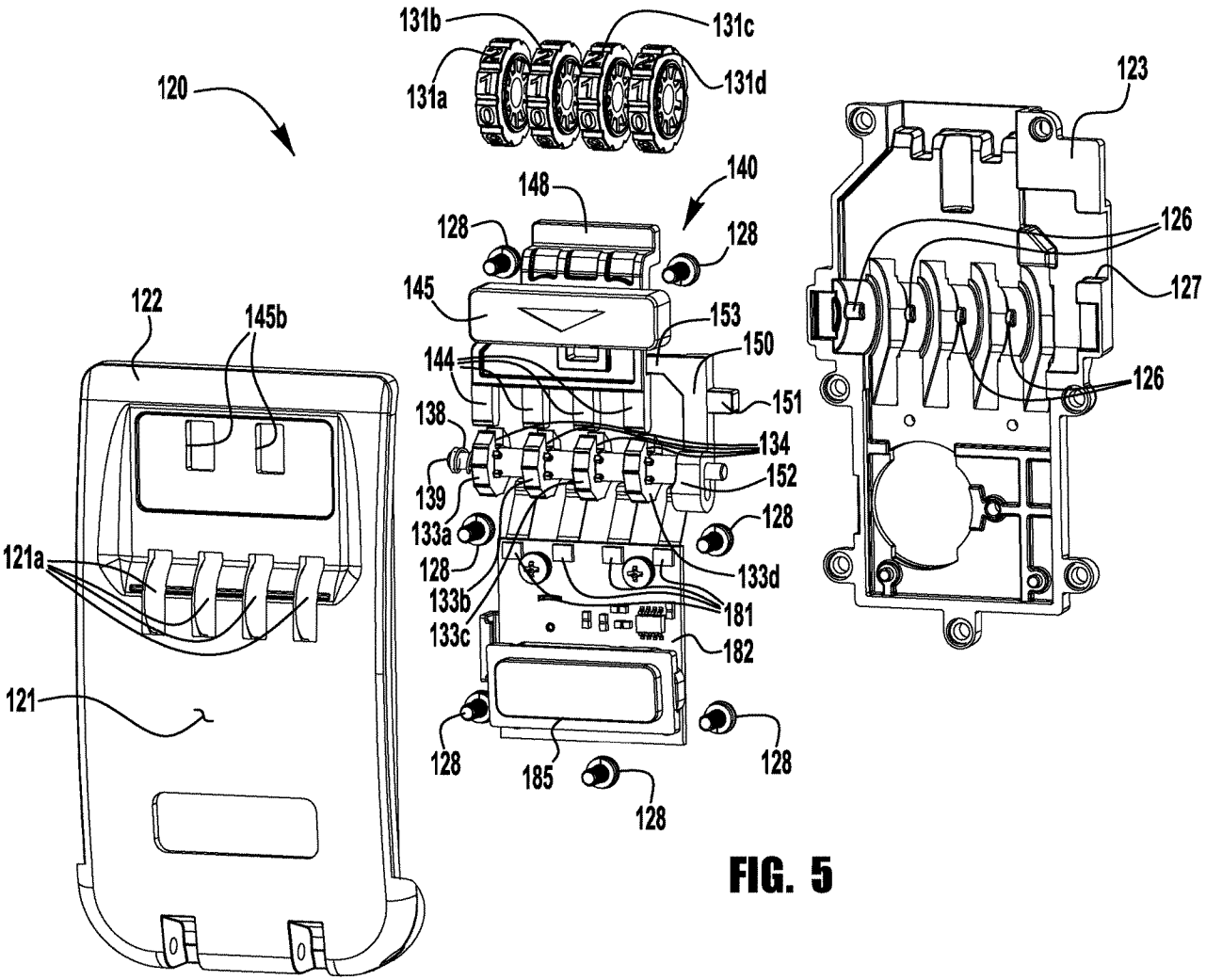
FIG. 5 illustrates an exploded front perspective view of the access door of the lockable enclosure of FIG. 1A.
Figure 6:
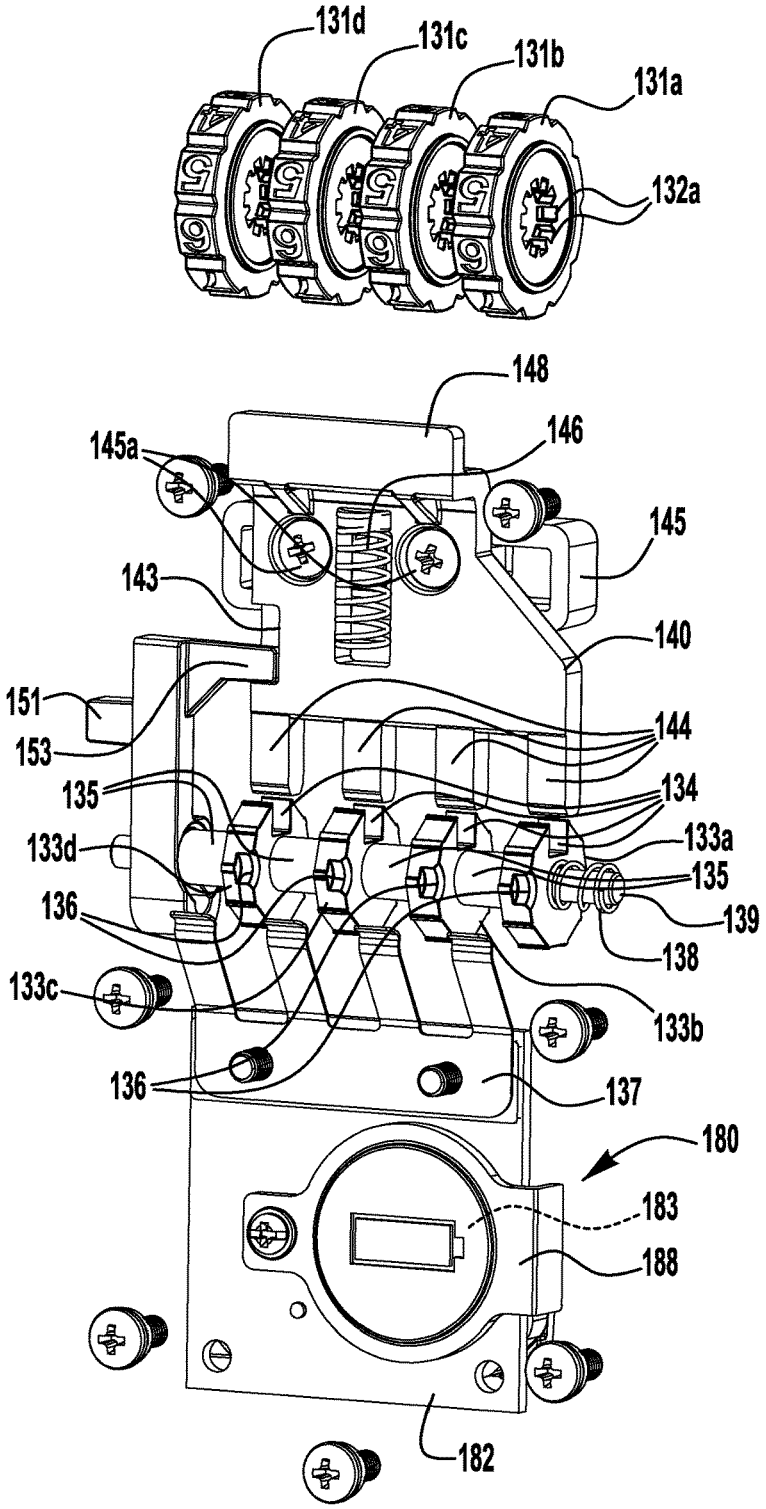
FIG. 6 illustrates an exploded rear perspective view of the internal components of the access door of the lockable enclosure of FIG. 1A.
Figure 7:
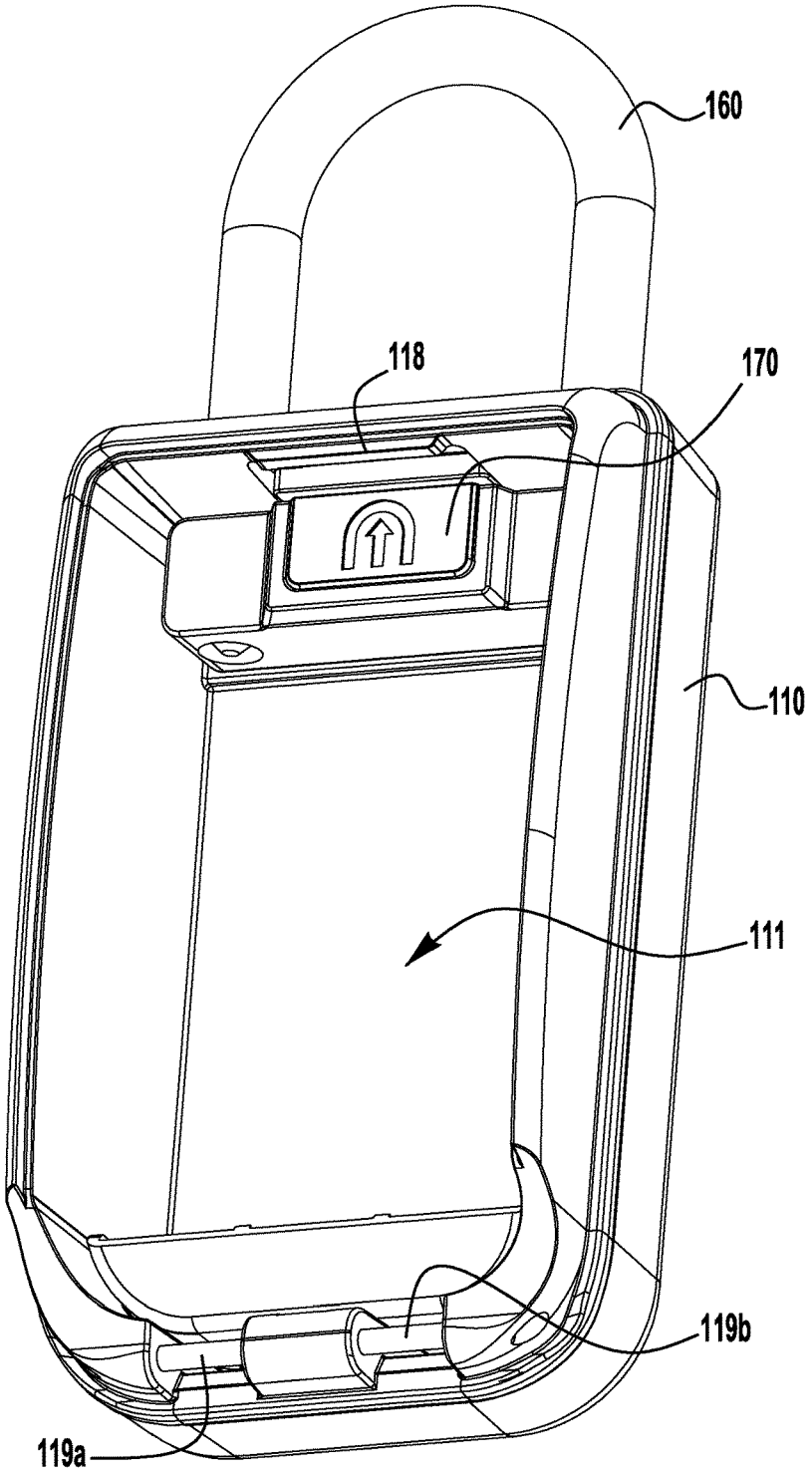
FIG. 7 illustrates a front perspective view of the housing of the lockable enclosure of FIG. 1A.

The access door 120, as shown in the exploded views of FIGS. 5 and 6, includes a front base member 122 defining the front surface 121 and through openings 121*a* of the access door, and a rear shell member 123 secured to the base member (e.g., by screws or other fasteners 128) to retain the dials 130*a*, 130*b*, 130*c*, 130*d* and a sliding latch member 140 therebetween. The dials are rotatable about a post 139 extending along a first axis A1. A spring detent plate 137 is secured between the base member 122 and the shell member 123 to hold the dials 130*a*, 130*b*, 130*c*, 130*d* in place against loose rotation in one of several set positions (for example, the numbered "0" through "9" positions on a conventional lock dial) when the dials are not being manually rotated by a user.

Each of the dials 130*a*, 130*b*, 130*c*, 130*d* includes an unlocking feature, such as, for example, a recess 134, disposed on an outer periphery. When the dials are each rotated to an unlocking orientation (as identified by the wheel indicia visible through the access door openings 121*a*), the recesses 134 are aligned with dial contacting portions 144 of the latch member 140 (which may, for example, include finger-like extensions). This allows the latch member to be moved axially (e.g., along axis A2, perpendicular to axis A1) from the extended or door latching position to the retracted or door releasing position, with the dial contacting portions 144 being received in engagement with the recesses 134. In the door releasing position, an end extension or latch bar portion 148 of the latch member 140 is retracted or withdrawn from an interlock portion 118 of the housing (e.g., a slot, recess, shoulder, flange, or tab) to permit movement of the access door 120 to the open position.

As shown in FIG. 2, a biasing spring 146 may be disposed between the latch member 140 and the access door (e.g., the base member 122) to bias the latch member toward the door latching position, such that the user must apply a retracting force to move the latch member 140 to the door releasing position, either to open the door or to return the door to the closed position. In another embodiment (not shown), the latch bar may be provided with a chamfered rear surface positioned to engage a front edge of the housing interlock portion when the access door is moved toward the closed position, such that further closing forces on the door retract the latch member against the biasing spring and into the door releasing position to fully close the door, upon which the biasing spring returns the latch member to the door latching position. In the illustrated embodiment, a release button 145 disposed on the front surface 121 of the access door 120 is affixed to the latch member 140 (e.g., by fasteners 145*a* through openings 145*b* in the base member 122) and is slideable by the user to move the latch member 140 to the door releasing position to open the door. In other embodiments (not shown), other user manipulable elements (e.g., dials, depressible buttons) may be utilized. In still other embodiments (not shown), an outer or front surface of the latch bar that engages the interlock portion of the housing may be chamfered or otherwise contoured such that a pulling or outward pivoting force applied to the access door causes the latch member to retract and disengage from the interlock portion.

To allow an authorized user to change the unlocking combination code for the lockable enclosure, the dials 130*a*, 130*b*, 130*c*, 130*d* may be configured such that an indicia bearing portion of each dial (e.g., a wheel) is separable from a recess-defining portion of the dial (e.g., a hub), for reorientation of the dial indicia with respect to the unlocking feature or recess of the dial. In the illustrated embodiment, each dial 130*a*, 130*b*, 130*c*, 130*d* includes a wheel 131*a*, 131*b*, 131*c*, 131*d* that engages a corresponding hub 133*a*, 133*b*, 133*c*, 133*d* on its inner diameter, for example, using interlocking teeth 132*a*, 132*b*, for rotation of the wheel and hub together as a dial. The wheels 131*a*, 131*b*, 131*c*, 131*d* define an indicia-bearing outermost surface of the dials, protruding through the openings 121*a* in the housing 121 for user grasping and rotation, while the hubs 133*a*, 133*b*, 133*c*, 133*d* define the outer peripheral recesses 134 of each dial. The hubs are positioned in a cavity, between the door base member 122 and the door shell member 123, sized to permit axial movement of the hubs 133*a*, 133*b*, 133*c*, 133*d* between a wheel engaging first axial position in which the hubs engage the wheels for rotation therewith, and a wheel disengaged second axial position in which the hubs are disengaged from the wheels to permit rotation of the wheels with respect to the hubs for reorientation of the dial indicia of the wheels with respect to the unlocking recesses of the hubs.

In the illustrated embodiment, the first, second and third hubs 133*a*, 133*b*, 133*c* include axially extending collar portions 135 that extend over the post 139 and into abutment with an adjacent hub 133*b*, 133*c*, 133*d*, such that an axial force applied to the fourth hub 133*d* causes axial movement of each of the hubs 133*a*, 133*b*, 133*c*, 133*d* along the post 139 to the wheel disengaged position. While the collar portions 135 are shown as being integral to the corresponding hubs, in another embodiment (not shown), the collar portions may be separate from the hubs, functioning as spacers for the axial movement of the hubs and spacers together on the post. In still another embodiment (not shown), the hubs may be axially fixed to the post, such that the post and hubs are axially movable together between the wheel engaging position and the wheel disengaged position.

As shown, the hubs 133*a*, 133*b*, 133*c*, 133*d* may be spring biased (e.g., by end spring 138) to bias the hubs into the wheel engaging position. Further, the hubs and the access door cavity may include interengaging portions that block axial movement of the hubs to the wheel disengaging position when any of the hubs is not in the unlocking orientation, and that interlock when the hubs are all in the unlocking orientation and are moved to the wheel disengaging position, to prevent rotation of the hubs out of the unlocking orientation during the code changing operation. In the illustrated example, the hubs 133*a*, 133*b*, 133*c*, 133*d* include side recesses or cutouts 136 (FIGS. 6 and 10) that align with interior nibs or projections 126 (FIG. 5) on the door shell portion 123 when the hubs are in the unlocking orientation, thus allowing axial movement of the hubs 133*a*, 133*b*, 133*c*, 133*d* to the wheel disengaged position. In the wheel disengaged position, the cutouts 136 and projections 126 interlock to prevent rotation of the hubs. In other embodiments, other combinations of interengaging features may be utilized, including, for example, projections on the hubs and cutouts in the door cavity.

The lockable enclosure 100 is configured to allow an authorized user to change the combination code only when the access door 120 is in the open position. As best seen in FIG. 3, a code change member 150 is carried by the access door 120 and is disposed between the base member 122 and the shell member 123, with a user graspable lever portion 151 extending through or accessible through a side opening or cutout 127 in the shell member 123 (see FIG. 1B). In other embodiments (not shown), the lever portion may be exposed on other surfaces of the access door that are blocked from user access when the door is in the closed position, such as, for example, upper or interior surfaces of the access door. When the code changing member 150 is moved (by user manipulation of the lever portion 151) from a code maintaining position to a code changing position, a hub shifting portion 152 of the code changing member engages the fourth hub 133*d* to move the hubs 133*a*, 133*b*, 133*c*, 133*d* from the wheel engaging position to the wheel disengaged position. While any suitable hub engaging structure may be utilized, in the illustrated embodiment, the hub shifting portion 152 includes a ramped surface 152*a* contoured to engage and push the collar portion of the fourth hub 133*d* when the code changing member is moved along an axis A3 parallel to the axis of movement A2 of the latch member 140, and perpendicular to the rotational axis A1 of the post 139 (and axis of movement of the disengaging hubs).

Upon disengagement of the hubs 133*a*, 133*b*, 133*c*, 133*d* from the wheels 131*a*, 131*b*, 131*c*, 131*d*, one or more of the wheels may be rotated to new unlocking orientations to establish a new authorized combination. Once the new combination has been set, the code change member 150 may be returned to the original, code maintaining position (by user movement of the lever portion 151), and the biasing spring 138 returns the hubs to the wheel engaging position, reengaging the hubs with the wheels.

According to another aspect of the present application, the lockable enclosure may be configured such that the code change member is automatically returned to the code maintaining position when the access door is closed by the user, thereby preventing the hubs from being left in the wheel disengaged position by a user who has forgotten to manually move the lever portion of the code changing member after changing the combination code.

In the illustrated embodiment, the code changing member 150 includes a latch engaging portion 153 that is moved by the latch member 140 to return the code changing member to the code maintaining position when the latch member 140 is moved to the door releasing position. While many different structural arrangements may be utilized, in the illustrated example, the latch engaging portion 153 is a projection that extends into a cutout portion 143 of the latch member 140. When the latch member is in the door latching position, the cutout defines an elongated slot in which the latch engaging projection 153 may move from a lower position, corresponding to the code maintaining position of the code changing member, to an upper position, corresponding to the code changing position of the code changing member. When the code changing member has been left in the code changing position and the access door 120 is moved to the closed position, the movement of the latch member 140 from the door latching position to the door releasing position to permit closing of the door causes the cutout portion 143 of the latch member 140 to engage the latch engaging portion 153 and move the code changing member 150 from the code changing position to the code maintaining position, reengaging the hubs 133*a*, 133*b*, 133*c*, 133*d* with the wheels 131*a*, 131*b*, 131*c*, 131*d*, as described above.

Figure 9:
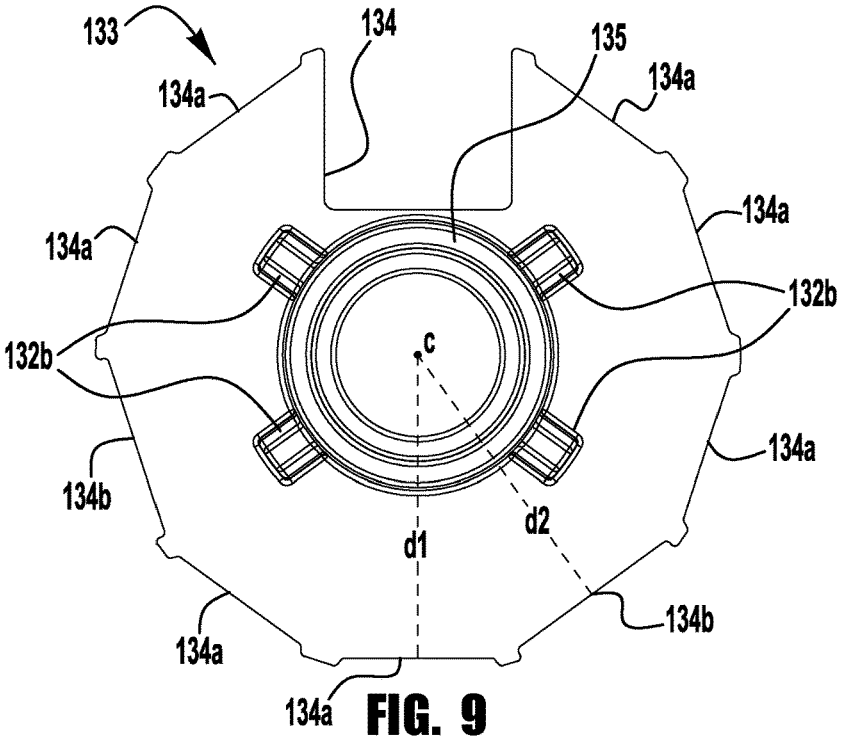
FIG. 9 is a first side view of a dial hub of the lockable enclosure of FIG. 1A.
Figure 10:
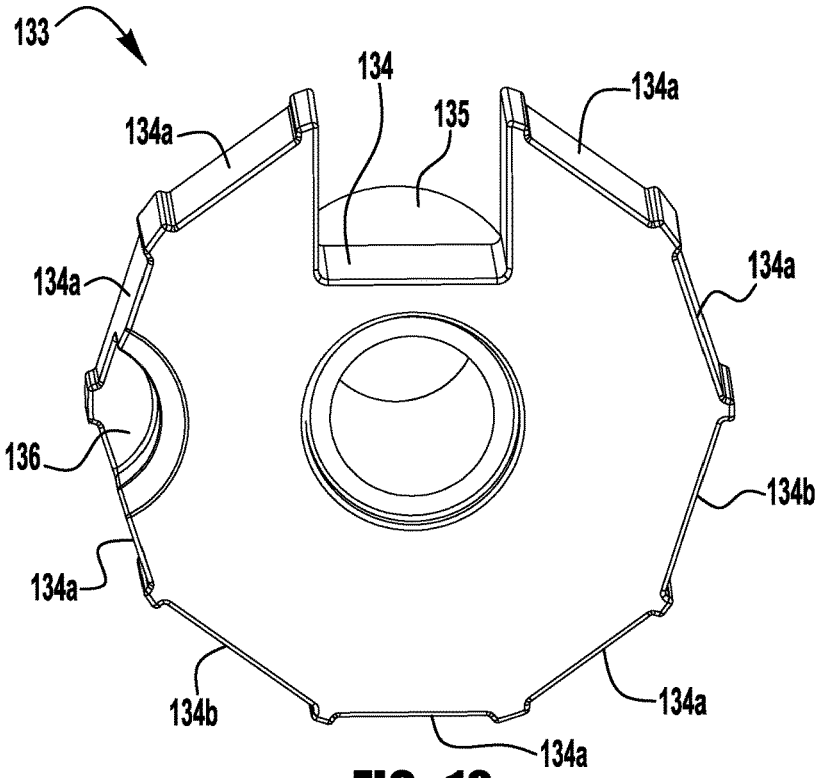
FIG. 10 is a second side perspective view of the dial hub of FIG. 9.

Other features and arrangements may additionally or alternatively be provided for a lockable enclosure in accordance with the present application. For example, as shown in FIGS. 9 and 10, each of the hubs 133 may be provided with a series of flats 134*a*, 134*b* that are configured to align with and oppose the corresponding dial contacting portion 144 of the latch member when the dial is in one of the rotational positions other than the unlocking orientation. When the release button 145 is pressed downward, the dial contacting portion 144 abuts the opposed flat 134*a*, 134*b*, obstructing rotation of the dial in this "pressed button" condition in an improper effort to "feel for" the unlocking orientation. Further, at least one of the flats 134*b* may be provided at a reduced distance d2 from the center point c of the hub 133, as compared to a distance d1 of other flats 134*a* of the hub. This reduced distance d2 results in additional axial travel of the latch member 140 (i.e., along axis A2, FIG. 3) when these "reduced distance" flats 134*b* are aligned with the dial contacting portions 144 of the latch member 140 and the release button 170 is pressed, or an increased distance to the flat as detected by an inserted picking tool. This condition can provide a false indication of an unlocked dial orientation to an individual attempting to manually pick the lock.

Figure 8:
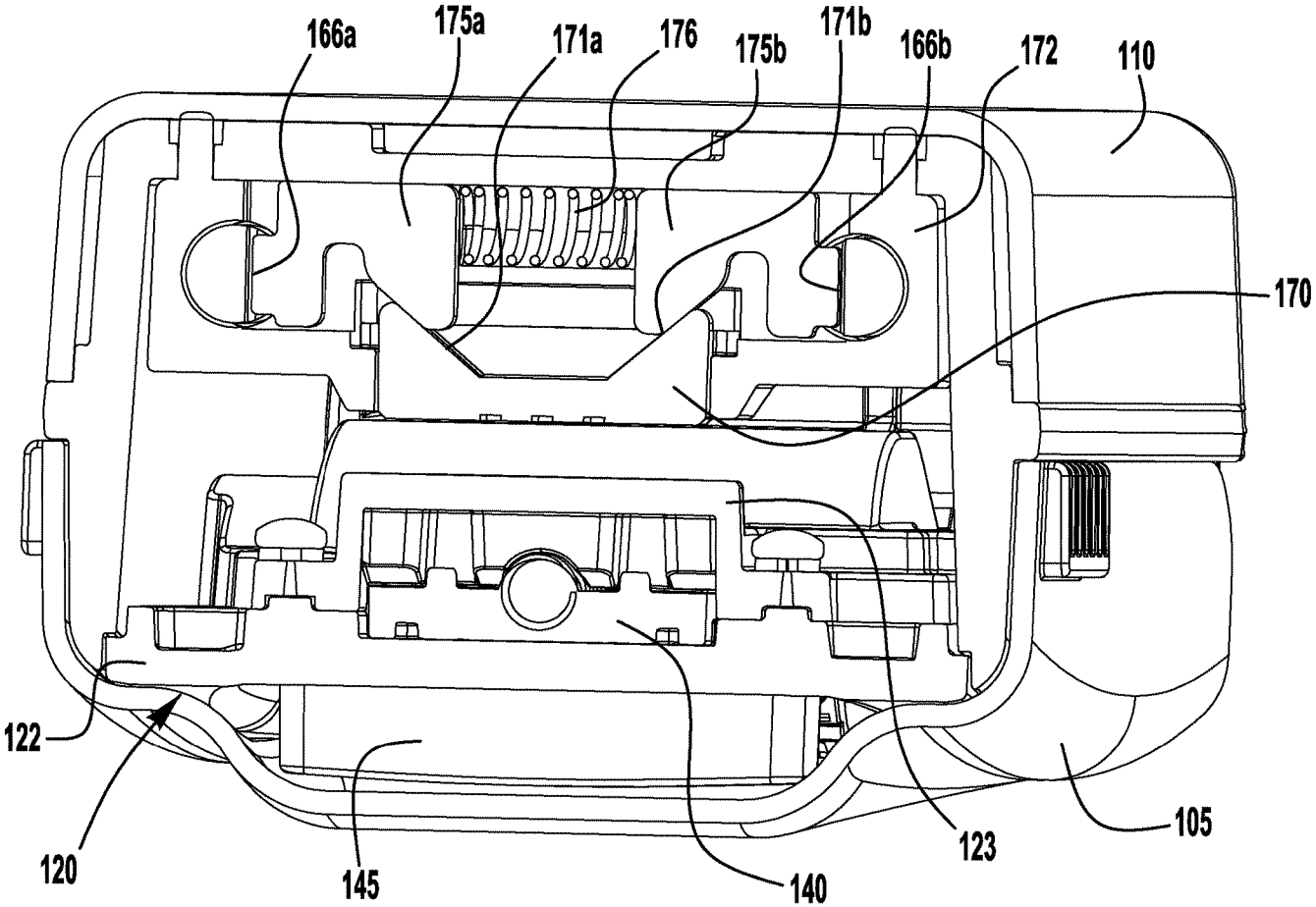
FIG. 8 illustrates a top cross-sectional view of the lockable enclosure of FIG. 1A.

As another example, a lockable enclosure may be provided with a releasable shackle for secure attachment of the lockable enclosure to an external structure (e.g., doorknob of an entry door, hasp of a gate). While the shackle may be provided with its own locking mechanism (e.g., key cylinder, combination dial) for release from the external structure, in the illustrated embodiment, the shackle 160 is secured to the housing 110 of the lockable enclosure by an internal button operated release mechanism accessible only when the access door 120 is in the open position. In the exemplary embodiment, as shown in FIG. 8, the release mechanism includes a modular body 172 mounted to the interior of the housing 110 by a mounting bracket 173 (see FIG. 2), with the body receiving ends of the shackle 160. The body 172 carries a release button 170 that is accessible when the access door 120 is open. The release button 170 includes ramped camming surfaces 171*a*, 171*b* that engage corresponding ramped surfaces of lock plates 175*a*, 175*b* within the body, to retract the lock plates (against spring 176) from shackle notches 166*a*, 166*b* for release of the shackle 160. In an alternative embodiment (not shown), a lockable enclosure may be provided without a releasable shackle, instead utilizing wall mount fasteners secured through the rear wall of the housing from inside the enclosure, such that the access door must be open to loosen and remove the fasteners.

According to another aspect of the present application, a lockable enclosure may be provided with a lighting arrangement carried by the access door and configured to illuminate the combination dials for visibility in dim or dark conditions. In the illustrated embodiment, a lighting arrangement 180 includes a plurality of light emitting diodes (LEDs) 181 mounted to a PC board 182 secured within the access door, and powered by a battery 183 mounted to the door shell member 123 by a battery door 188. A switch 184 (FIG. 2), disposed on the PC board 182 and electrically connected with the LEDs 181 via the PC board, is positioned to be held in a depressed, open condition by the cover member 105 (e.g., by a protrusion 106 on the interior surface of the cover member, see FIG. 1) when the cover member is in the closed position. When the cover member 105 is moved to the open position, the switch 184 is released to a closed condition for powering the LEDs 181. In the illustrated embodiment, a soft (e.g., rubber, polyethylene) switch cover 185 is provided over the switch 184, for example, to protect the switch and PC board from moisture and other contaminants. The PC board 182 may include a timing circuit configured to limit the duration (e.g., 20 seconds) that the LEDs are illuminated, for example, to limit drain of the battery 183 in situations where the cover member 105 has been left in the open position.

In the illustrated embodiment, a storage tray 115 is retained in the housing cavity 111, for example, to retain smaller items, preventing these items from slipping between the access door 120 and the housing edge when the access door is opened. As shown, the housing 110 may include interior guide walls 117 to retain the storage tray 115 while allowing the storage tray to be pulled or slid from the cavity 111.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions-such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative indicators and ranges may be included to assist in understanding the present disclosure; however, such indicators and ranges are not to be construed in a limiting sense and are intended to be critical indicators or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

I claim:

1. A lockable enclosure comprising:

a housing;

an access door assembled with the housing and movable between a closed position blocking access to a cavity within the housing and an open position permitting access to the cavity;

a plurality of dials carried by the access door and rotatable about a post extending along a second axis;

a latch carried by the access door and including a housing engaging portion and a plurality of dial engaging portion together slideable along a first axis between a door latching position in which the housing engaging portion of the latch engages an interlock portion of the housing to secure the access door in the closed position, and a door releasing position in which the housing engaging portion of the latch disengages from the interlock portion of the housing to permit movement of the access door to the open position; and a plurality of dials carried by the access door and rotatable about a post extending along a second axis, wherein when each of the plurality of dials is rotated to an unlocking orientation, an outer peripheral recess on each of the dials aligns with the corresponding dial engaging portion of the latch, allowing the latch to slide along the first axis from the door latching position to the door releasing position, with each of the dial engaging portions being received in a corresponding one of the recesses.

2. The lockable enclosure of claim 1, wherein each of the plurality of dials includes a central hub defining the outer peripheral recess, and a user graspable wheel that interlocks with the corresponding hub for rotation therewith, the hub being separable from the corresponding wheel to change the rotational orientation of the wheel with respect to the outer peripheral recess.

3. The lockable enclosure of claim 2, wherein each of the plurality of hubs is axially fixed on the post, the lockable enclosure further comprising a code changing member carried by the access door and movable from a code maintaining position to a code changing position to slide the post and the plurality of hubs along the second axis from a wheel engaging position to a wheel disengaged position.

4. The lockable enclosure of claim 3 wherein the code changing member includes a user graspable lever portion for user sliding movement of the code change member along a third axis to the code changing position.

5. The lockable enclosure of claim 4, wherein the third axis is parallel to the first axis.

6. The lockable enclosure of claim 4, wherein user access to the user graspable lever portion is blocked when the access door is in the closed position.

7. The lockable enclosure of claim 3, wherein the code changing member includes a latch engaging portion, wherein when the code changing member is in the code changing position, movement of the latch from the door latching position to the door releasing position causes the latch to engage the latch engaging portion of the code changing member for movement of the code changing member to the code maintaining position.

8. The lockable enclosure of claim 7, wherein the latch engaging portion of the code changing member includes a projection received in a cutout portion of the latch member.

9. The lockable enclosure of claim 3, wherein the post is spring biased to return the plurality of hubs to the wheel engaging position.

10. The lockable enclosure of claim 3, wherein the code changing member engages an endmost one of the plurality of hubs.

11. The lockable enclosure of claim 3, wherein the code changing member includes a ramped surface that engages an endmost one of the plurality of hubs to slide the post and the plurality of hubs along the second axis from the wheel engaging position to the wheel disengaged position.

12. The lockable enclosure of claim 3, wherein each of the plurality of hubs includes a first detent portion that interlocks with a corresponding one of a plurality of second detent portions of the housing when the plurality of hubs are in the wheel disengaged position to prevent rotation of the plurality of hubs out of the unlocking orientation.

13. The lockable enclosure of claim 12, wherein each of the first detent portions comprises a cutout and each of the second detent portions comprises a projection sized to be received in the corresponding cutout when the plurality of hubs are in the unlocking orientation and in the wheel disengaged position.

14. The lockable enclosure of claim 1, wherein the latch is spring biased toward the door latching position.

15. The lockable enclosure of claim 1, wherein the dial engaging portions of the latch comprise a plurality of finger-like extensions.

16. The lockable enclosure of claim 1, further comprising a release button affixed to the latch and extending through a front surface of the access door for user movement of the latch to the door releasing position when each of the plurality of dials is in the unlocking orientation.

17. The lockable enclosure of claim 1, further comprising a cover member assembled with the access door and movable between a first position covering user graspable portions of the plurality of dials and a second position exposing the user graspable portions of the plurality of dials.

18. The lockable enclosure of claim 17, further comprising a lighting arrangement carried by the access door, the lighting arrangement including at least one light source and a switch in circuit communication with the at least one light source, wherein movement of the cover member to the second position actuates the switch to illuminate the light source.

19. The lockable enclosure of claim 1, wherein each of the plurality of dials includes a plurality of flats around a circumference on which the outer peripheral recess is disposed, such that when one of the plurality of flats is aligned with a corresponding one of the dial engaging portions of the latch, the one of the plurality of flats blocks movement of the latch to the door releasing position.

20. The lockable enclosure of claim 19, wherein the plurality of flats includes a first flat disposed at a first radial distance from a center point of the dial, and a second flat disposed at a second radial distance from a center point of the dial, the second radial distance being smaller than the first radial distance, such that alignment of the second flat with the corresponding one of the dial engaging portions of the latch permits greater axial travel of the corresponding one of the dial engaging portions of the latch as compared to alignment of the first flat with the corresponding one of the dial engaging portions of the latch, thereby providing a false indication that the corresponding dial is in the unlocking orientation.

* * * * *